US010685539B2

(12) United States Patent
Santino, Jr.

(10) Patent No.: US 10,685,539 B2
(45) Date of Patent: Jun. 16, 2020

(54) LAST LAP LIGHT WITH EXTENDIBLE POLE

(71) Applicant: Nicholas A. Santino, Jr., Newark, NY (US)

(72) Inventor: Nicholas A. Santino, Jr., Newark, NY (US)

( * ) Notice: Subject to any disclaimer, the term of this patent is extended or adjusted under 35 U.S.C. 154(b) by 0 days.

(21) Appl. No.: 16/234,712

(22) Filed: Dec. 28, 2018

(65) Prior Publication Data

US 2019/0206205 A1 Jul. 4, 2019

Related U.S. Application Data

(60) Provisional application No. 62/613,580, filed on Jan. 4, 2018.

(51) Int. Cl.

| | |
|---|---|
| ***G08B 7/06*** | (2006.01) |
| ***F21L 4/04*** | (2006.01) |
| ***A63B 71/06*** | (2006.01) |
| *F21W 111/10* | (2006.01) |
| *F21Y 115/10* | (2016.01) |

(52) U.S. Cl.

CPC ..... *G08B 7/06* (2013.01); *A63B 71/0622* (2013.01); *F21L 4/04* (2013.01); *A63B 2071/0625* (2013.01); *A63B 2244/20* (2013.01); *F21W 2111/10* (2013.01); *F21Y 2115/10* (2016.08)

(58) Field of Classification Search

CPC ..... A63B 2017/0625; A63B 2244/20; A63B 71/0622; F21V 21/22; F21V 31/005; F21V 33/0056; F21W 2111/10; F21Y 2107/30; F21Y 2115/10; G08B 7/06

See application file for complete search history.

(56) References Cited

U.S. PATENT DOCUMENTS

| | | | | |
|---|---|---|---|---|
| 3,665,452 | A | 5/1972 | MacCreadie | |
| 3,678,496 | A | 7/1972 | Stalp | |
| 3,916,214 | A | 10/1975 | Coble, Jr. et al. | |
| 3,944,763 | A | 3/1976 | Beierwaltes | |
| 3,955,076 | A | 5/1976 | Shaw | |
| D240,220 | S | 6/1976 | Meyer | |
| D240,811 | S | 8/1976 | Beall, Jr. | |
| 4,117,283 | A | 9/1978 | Hurzeller et al. | |
| 4,134,583 | A | 1/1979 | Davidson | |
| 4,194,101 | A | 3/1980 | Berseth | |
| 4,475,016 | A | 10/1984 | Berger | |
| 4,780,085 | A * | 10/1988 | Malone | A63B 71/06 340/323 R |
| 4,935,733 | A | 6/1990 | Munekata | |
| 5,349,569 | A * | 9/1994 | Tanaka | A63B 71/0686 200/52 R |

(Continued)

FOREIGN PATENT DOCUMENTS

JP 2000039518 2/2000

OTHER PUBLICATIONS

ME-Bro-170, Starting Platforms, S.R.Smith Commercial; www.srsmith.com; 6 pages. Jul. 7, 2019.

(Continued)

*Primary Examiner* — Sisay Yacob

(74) *Attorney, Agent, or Firm* — Duane C. Basch; Basch & Nickerson LLP

(57) ABSTRACT

Disclosed is a last lap light apparatus with extendible pole length, for submersible use in signaling, for example, in a swimming competition.

12 Claims, 8 Drawing Sheets

(56) References Cited

U.S. PATENT DOCUMENTS

| | | | | |
|---|---|---|---|---|
| 5,920,921 | A | 7/1999 | Poole | |
| 5,977,493 | A * | 11/1999 | Tanaka | H01H 3/141 200/52 R |
| 6,181,236 | B1 | 1/2001 | Schneider, Jr. | |
| 6,211,626 | B1 * | 4/2001 | Lys | A61N 5/0616 315/291 |
| 6,278,827 | B1 * | 8/2001 | Sugiyama | G02B 6/001 385/123 |
| D464,699 | S | 10/2002 | Brice | |
| 6,523,188 | B1 | 2/2003 | Kiefer et al. | |
| 7,193,167 | B1 | 3/2007 | Brice | |
| RE42,339 | E | 5/2011 | Brice | |
| 2001/0016105 | A1 * | 8/2001 | Sugiyama | G02B 6/001 385/133 |
| 2003/0006903 | A1 | 1/2003 | Naegely et al. | |
| 2003/0076281 | A1 | 4/2003 | Morgan et al. | |
| 2004/0233059 | A1 | 11/2004 | Smith et al. | |
| 2010/0165655 | A1 | 7/2010 | Alcov | |

OTHER PUBLICATIONS

Quickblox Establish New Starting Block Technology; Swimming World; 4 pages. Apr. 10, 2000.
SwimSight: Supporting Deaf Users to Participate in Swimming Games, Dan Samitha Elvitigal et al: 4 pages. Oct. 16, 2016.
Universal Design Starting System; 2 pages. Dec. 11, 2017.
USDS201 Universal Starting System 19APR, Marcus Titus; (13 pages). Dec. 11, 2017.
U.S. Pat. No. Re. 42,339 File History; 102 pages. Aug. 23, 2013.

* cited by examiner

LAST LAP LIGHT WITH EXTENDIBLE POLE

This application claims the benefit under 35 U.S.C. § 119(e) from U.S. Provisional Patent Application No. 62/613,580, for a LAST LAP LIGHT SISTEM WITH EXTENDIBLE POLE LENGTH, by Nicholas A. Santino, Jr., filed Jan. 4, 2018, and this application is a continuation-in-part of co-pending U.S. patent application Ser. No. 14/924,312 for a SYSTEM AND METHOD FOR ATHLETIC COMPETITION SIGNALLING, by Nicholas A. Santino, Jr., filed Oct. 27, 2015, both of which are hereby incorporated by reference in their entirety.

An extendible, pole-mounted, submersible light and sound generator and various alternatives are disclosed herein. Such a device is provided for use, for example, in swimming meets to signal to a lead swimmer that they are about to enter the last lap of the competition. The last lap light system employs both a visual and audible signal, presented on the end of a pole that may be held by a person on a pool deck and activated by a switch to signal a swimmer in the water. The device may also be used during practice and/or warm-up events to signal swimmers in a pool setting.

BACKGROUND AND SUMMARY

As specified in various swimming competition rules, for example *NCAA Swimming and Diving;* 2017-18 and 2018-19 *Rules and Interpretations*, (ISSN 0736-5128), The National Collegiate Athletic Association, Indianapolis, Ind. (August 2017), "A bell or air horn will be sounded when the leading competitor has two lengths plus five yards to swim." (p. 37) However, in the case of a hearing impaired competitor(s), audible signals may not be heard. Unable to perceive an audible cue, the hearing impaired competitor is forced to seek out a visual cue. For example, the hearing impaired swimmer must typically look up and observe a hand signal from a referee or coach to assure they are aware of the last lap signal, which potentially compromises the hearing impaired swimmer's stroke or body position in the midst of the competition. Consequently, in the interest of equality, it is imperative that any last lap system include at least a visual cue for the competitors.

In the case of hearing impaired competitor, audible signals may be supplemented with visual cues as well. For example, in the Swimmers Official's Guidelines Manual (July 2012), on page 26 under Modifications for the deaf and hard-of-hearing, the guide states "Deaf and hard of hearing swimmers require a visual starting signal, i.e., a strobe light and/or starter's arm signals. The modification may include the referee reassigning lanes within the swimmer's heat, i.e., exchanging one lane for another, so that the strobe light or starter's arm signal can more clearly be seen by the deaf or hard-of-hearing swimmer." Given the prerequisite that accommodations for special needs should be as transparent as possible, the interchanging of lanes, visual hand signals and providing a strobe light has been acknowledged as exceedingly intrusive in a hybrid event, and in some cases ineffective. The apparatus disclosed herein is directed to a solution for signaling swimmers entering their last lap, whether hearing impaired or not, using both visual and audible signals that can be readily sensed by a swimmer during a competition (e.g., freestyle race). The additional features of an extendable pole, replaceable battery, etc., make the apparatus easily transportable and suitable for adjustment or adaptation to various environments as well.

Disclosed in embodiments herein is an apparatus for providing a submerged signal, comprising: a handle, said handle including an electrical switch therein; an extension pole, stored within the handle, the extension pole being extendible from a stored position to an extended position; a signaling housing, including a transparent portion for the transmission of light from a light source within the transparent portion for viewing by a swimmer, and an audible signaling device; and a self-contained power source (e.g., 9V battery), connected to said electrical switch, wherein upon activating the switch (ON), the light source and the audible signaling device are both energized and produce light and sound, respectively.

Figure 1:
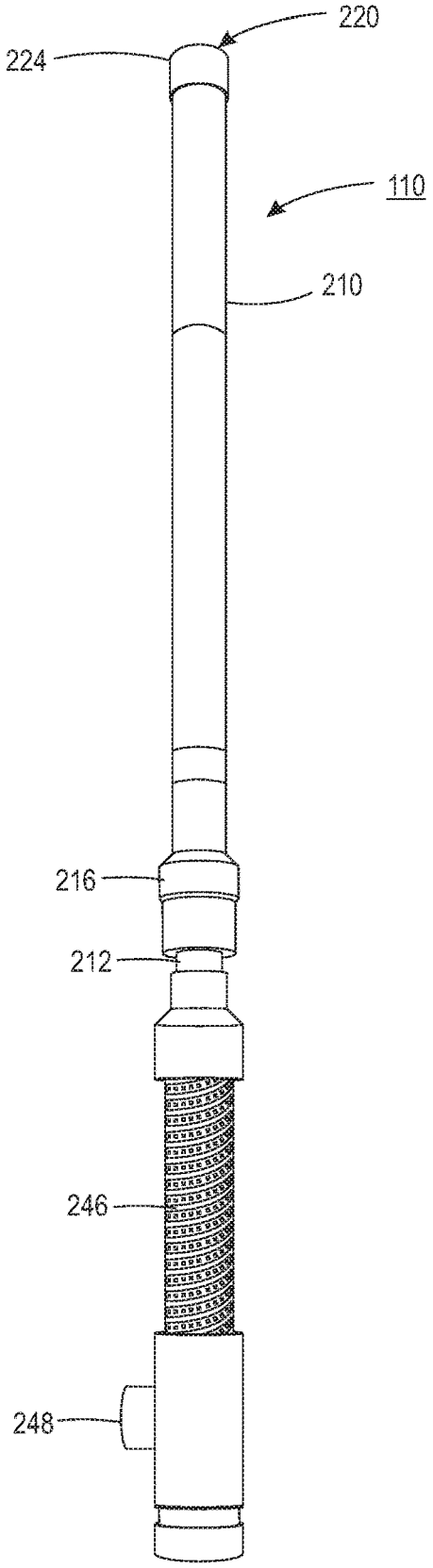
FIGS. 1 and 2 are illustrative examples of an embodiment of the last lap apparatus in a non-extended configuration.

The various embodiments described herein are not intended to limit the disclosure to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

Figure 2:
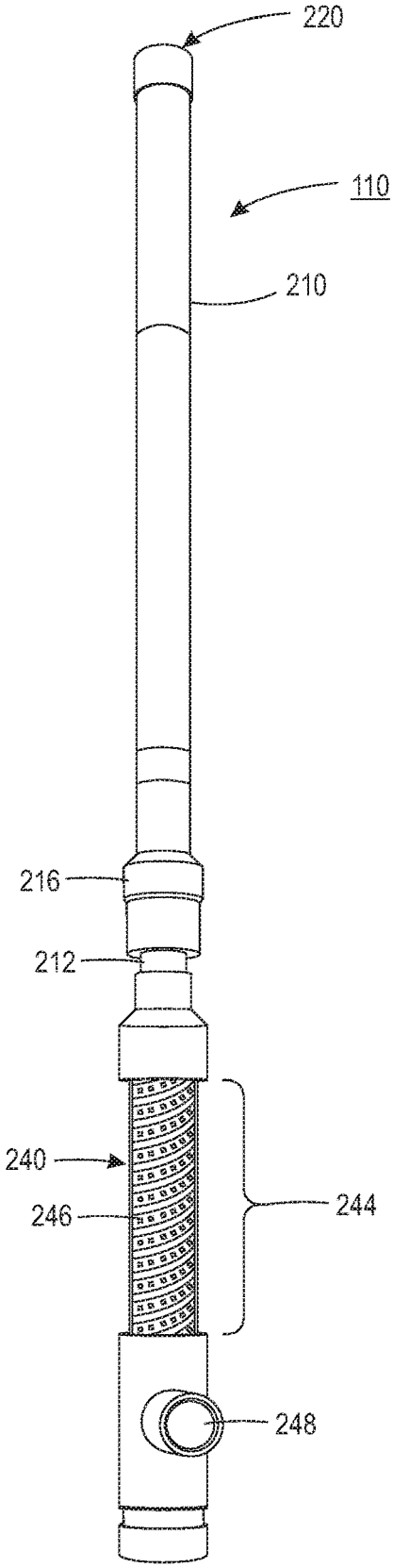
Figure 3:
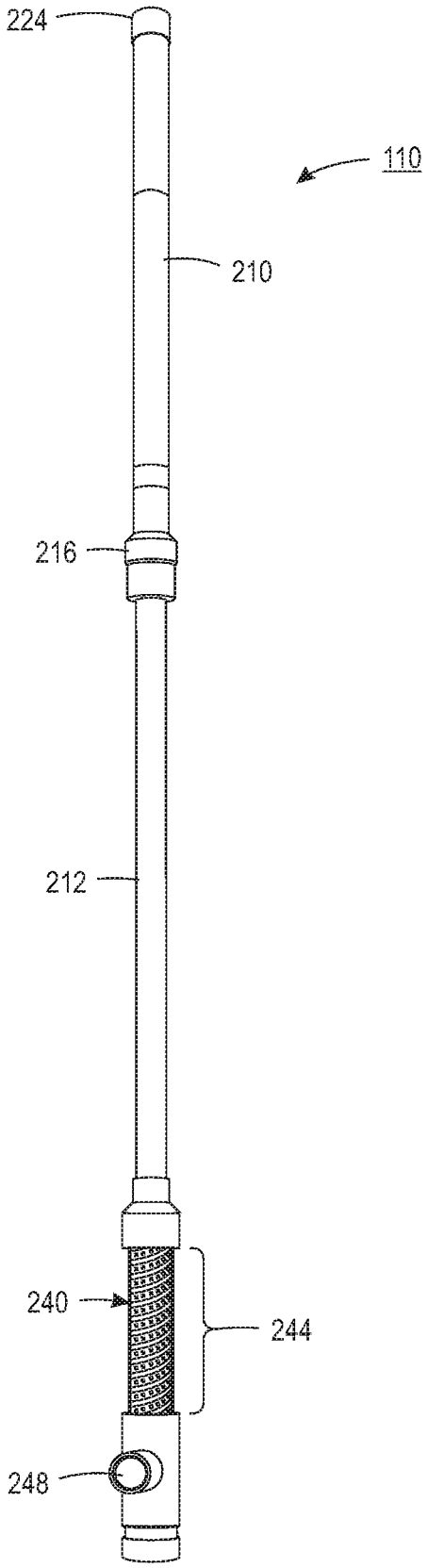
FIG. 3 depicts an embodiment of the last lap apparatus in an extended configuration.

Referring initially to FIGS. 1-3, depicted therein are various views of a signaling apparatus 110 for providing a submerged visible and audible signal for a swimming event or other activity. As illustrated the apparatus consists of several components including a handle 210, the handle including at least one electrical switch 220 at the top end of the handle. The electrical switch 220 may be a push-button type switch so that it is easily activated by pressing down on a flexible covering 224 at the upper end of handle 210. The handle 210 houses (stores) a telescoping extension pole 212 that both slides into the handle when collapsed for storage (collapsed position) and extends outward from the handle to reach an overall length of approximately 4-6 feet (expended position). The position of the extension pole may be held or locked into place by any releasable locking mechanism 216 (e.g., push-pin, twist-lock, lever, etc.), and may be stored within the handle. The extension pole is extendible from the collapsed position (e.g., FIGS. 1-2, 6A) to the extended position (e.g., FIG. 3, 6B). Moreover, with a twist-type locking mechanism the length of the pole during use may be adjusted to any desirable length between the collapsed and extended lengths.

At the distal end of the extension pole 212 a water-tight signaling housing 240 is attached. Included in the signaling housing is a transparent portion 244 for the transmission of light 234 from a light source 246 located within the transparent portion. The use of the transparent portion allows for viewing of the light source, when activated (see e.g., FIGS. 5A-6B), by a swimmer or other competitor within the pool. The signaling housing 240 also includes an audible signaling device such as a transducer (e.g., speaker, buzzer, piezo-buzzer, horn, sounder) at location 248 that is used to produce an output sound, note or alarm.

Figure 4:
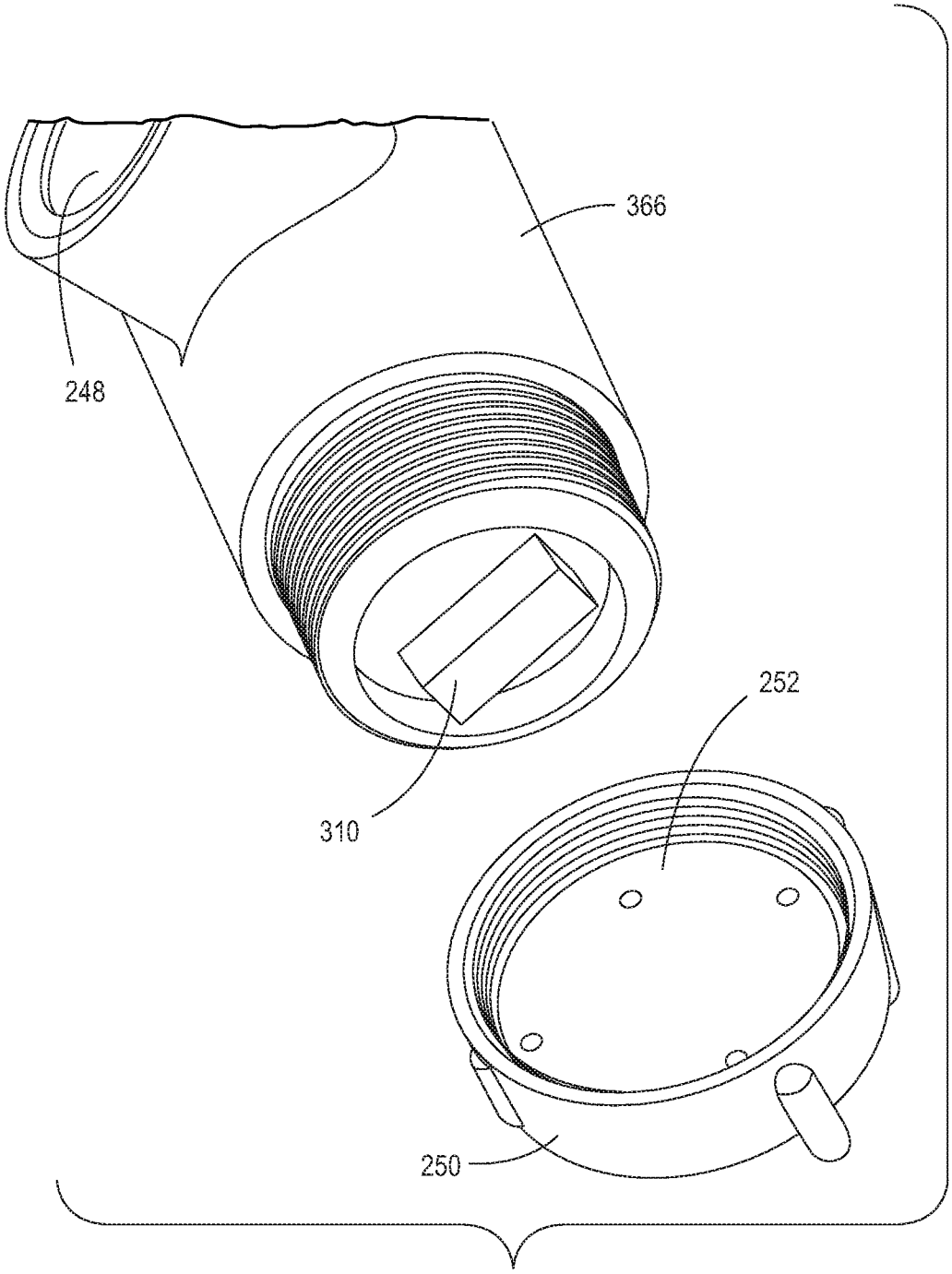
FIG. 4 is an enlarged view of the lower end of the apparatus of FIGS. 1-3, with a battery cap removed.
Figure 5A:
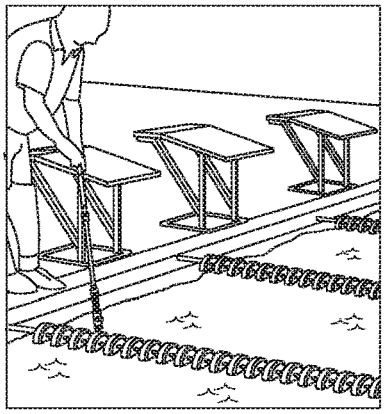
FIGS. 5A-5C are sequential views of an exemplary use of the apparatus.
Figure 5B:
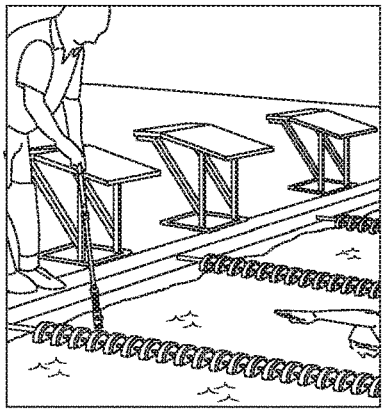
Figure 5C:
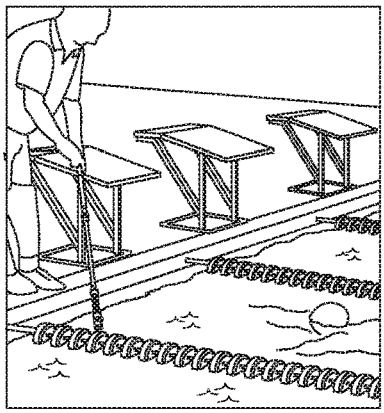

Apparatus 110 further includes a self-contained power source (e.g., a 9V battery) 310 at the bottom of the signaling housing as depicted in FIG. 4, connected to the electrical switch. It will be appreciated that the battery may be rechargeable, and that a wireless (e.g., inductive) charger may be employed, or a charging connection may be wired near the switch on the other end of the apparatus so as to avoid its submersion. Once the pole has been extended or adjusted to a desired length by a user, the user (e.g., meet official) activates the switch (ON) and the light source and the audible signaling device are both energized and produce light and sound, respectively. The apparatus 110 may be moved at the end of the lane in front of an approaching swimmer as illustrated by the series of illustrations set forth in FIGS. 5A-5C.

Figure 6A:
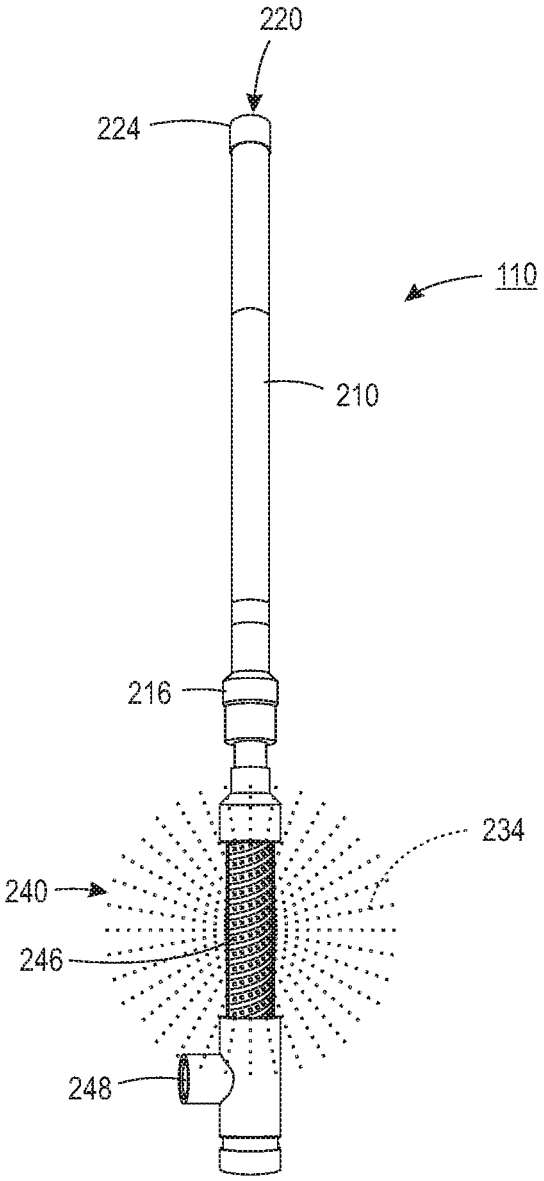
FIGS. 6A-6B are illustrative examples of the apparatus in a non-extended (collapsed) and extended configuration, respectively.
Figure 6B:
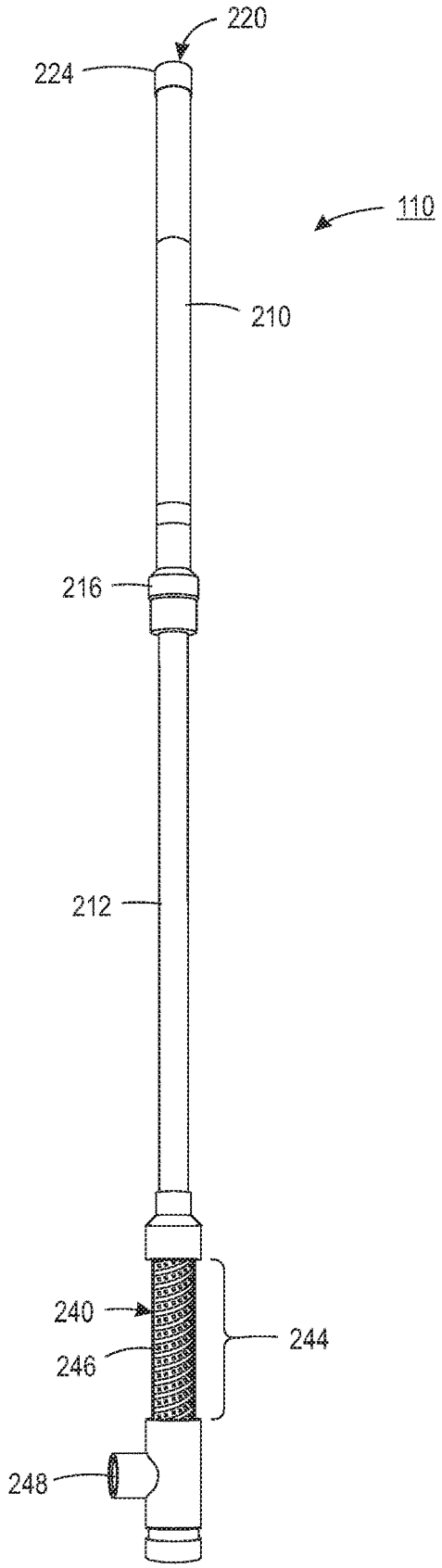

As further depicted in FIG. 6A, for example, the light source 246 may include a plurality of light-emitting diodes (LEDs) that are energized in response to the switch being activated. For the audible signaling device at location 248, while a number of water-proof sound generation devices or techniques may be employed, the embodiments depicted include a piezo-electric sound generating chip at location 248 that, like the LEDs 352, is energized and outputs a tone when the switch 220 is activated. Thus, the swimmer that is approaching a final lap is alerted to that fact by the light and tone emanating from the submerged signaling housing.

As will be appreciated by those familiar with electronic components such as LEDs and piezo-electric chips, the apparatus may further include control circuitry connected to the battery power source, wherein the light source and audible signaling device, in response to the electrical switch, cause the flow of electrical current to the light source and the audible signaling device, and both then generate, respectively, visual and audible signals. Furthermore, the construction of the LED light array may be similar to that disclosed in co-pending U.S. application Ser. No. 14/924,312 previously incorporated by reference in its entirety, and as more specifically described relative to FIG. 7 below.

As depicted in FIG. 4, in one embodiment of apparatus 110, signaling housing 240 includes a self-contained power source (battery) therein. The signaling housing is intentionally constructed in a watertight manner, and a threaded cap 250 includes a gasket or O-ring 252 therein to assure a watertight seal when fastened to the bottom of the fitting or cap 366 on signaling housing 240.

Figure 7:
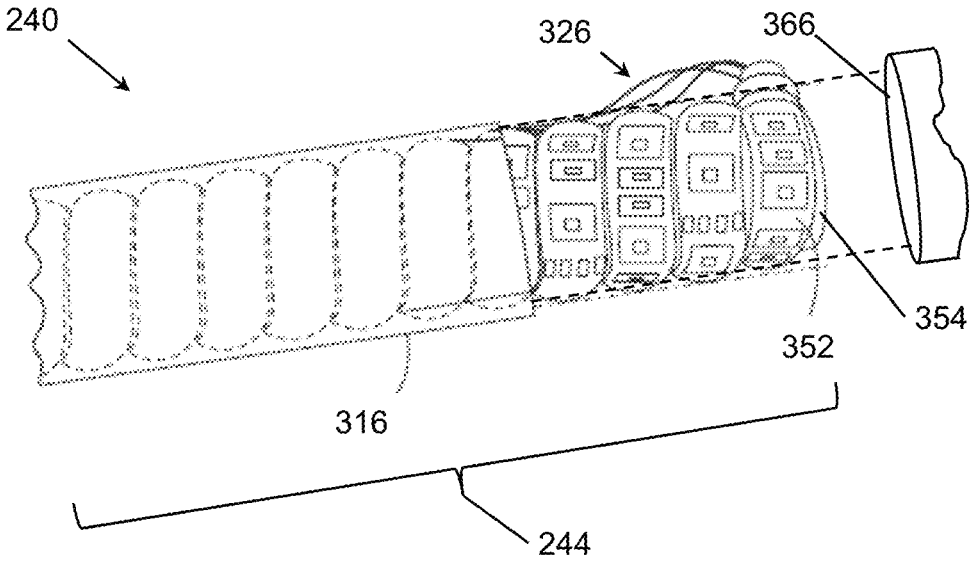
FIG. 7 is a representation of the components in the signaling housing used as part of the signaling apparatus.

Further considering the detailed illustration of FIG. 7, depicted therein are additional components in the signaling housing 240 used as part of the signaling apparatus. In particular, within portion 244, which is generally tubular in shape, is included a cylindrical transparent or translucent tube 316. A tape or ribbon 352 of single- or multi-colored light-emitting diodes (LEDs) is spirally wrapped about a cylindrical core 354 and the wrapped core is inserted within the translucent outer tube 316 after electrical connections are made to wires 326. The tube has, at one or both ends, a sealable fitting or cap 366 applied to the ends thereof to hold the LEDs inside and to prevent the LEDS from environmental exposure (e.g., water-tight to prevent leakage when submerged).

Depending upon the configuration, one of the fittings or caps may include a hole or aperture to allow wires 326 to pass through and up to switch 220 (e.g., FIG. 1) located at the opposite end of the apparatus, at or near the top of the extendible pole. Moreover, the wiring is connected to the electronic circuitry in the housing 240 and provides power/signals to the LED tape 352 as well as the transducer at 248, in order to control the on/off state (and possibly color, flashing pattern, etc.) of the LEDs and the transducer. It will be appreciated that while a push-button switch 220 may be employed to simply control the LED light source as on or off, the push-button switch, in conjunction with control circuitry, may also be used to select a color of the light and/or a flashing pattern for the LEDs 352.

It should be understood that various changes and modifications to the embodiments described herein will be apparent to those skilled in the art. Such changes and modifications can be made without departing from the spirit and scope of the present disclosure and without diminishing its intended advantages. It is therefore anticipated that all such changes and modifications be covered by the instant application.

What is claimed is:

1. An apparatus for providing a submerged signal beneath a water surface, comprising:

a handle, said handle including an electrical switch therein;

an extension pole, stored within the handle, the extension pole being extendible from a collapsed position to an extended position;

a signaling housing, suitable for placement beneath the water surface, including a transparent portion for the transmission of light from a light source within the transparent portion viewable beneath the water surface, and an audible signaling device which may be heard beneath the water surface; and a self-contained power source, connected to said electrical switch, wherein upon activating the switch (ON), the light source and the audible signaling device are both energized and produce light and sound, respectively.

2. The apparatus according to claim 1, wherein said light source includes a plurality of light-emitting diodes.

3. The apparatus according to claim 1, wherein said audible signaling device includes a piezo-electric sound generating chip.

4. The apparatus according to claim 1, further including control circuitry, connected to said power source, said light source and said audible signaling device, wherein the control circuitry is responsive to the electrical switch and causes the flow of current to the light source and the audible signaling device to generate both the visual and audible signals.

5. The apparatus according to claim 1, wherein said signaling housing includes said power source therein.

6. The apparatus according to claim 5, wherein said signaling housing is watertight.

7. The apparatus according to claim 1, wherein said electrical switch is a push-button type switch.

8. The apparatus according to claim 1, wherein said extension pole is a telescoping extension pole.

9. The apparatus according to claim 1, wherein said light source includes a ribbon of light-emitting diodes wrapped about a cylindrical core and inserted within the transparent portion to isolate the light-emitting diodes from environmental exposure.

10. The apparatus according to claim 1, wherein said audible signaling device includes a transducer.

11. The apparatus according to claim 10, wherein said transducer is a piezoelectric device.

12. The apparatus according to claim 10, wherein said transducer is selected from the group consisting of: a speaker, a buzzer, a horn and a sounder.

* * * * *